US011502449B2

(12) United States Patent
Wang

(10) Patent No.: US 11,502,449 B2
(45) Date of Patent: Nov. 15, 2022

(54) PRE-ORGANIZED WIRE FASTENING DEVICE, ELECTRIC PLUG CONNECTOR ADOPTING STRUCTURE AND FEMALE SEAT THEREOF

(71) Applicant: JIANGSU ENMAN ELECTRONIC INDUSTRY CO., LTD., Kunshan (CN)

(72) Inventor: Chuanbao Wang, Huainan (CN)

( * ) Notice: Subject to any disclaimer, the term of this patent is extended or adjusted under 35 U.S.C. 154(b) by 3 days.

(21) Appl. No.: 17/052,439

(22) PCT Filed: Jan. 14, 2019

(86) PCT No.: PCT/CN2019/071639

§ 371 (c)(1),
(2) Date: Nov. 2, 2020

(87) PCT Pub. No.: WO2020/133593

PCT Pub. Date: Jul. 2, 2020

(65) Prior Publication Data

US 2021/0184394 A1 Jun. 17, 2021

(30) Foreign Application Priority Data

Dec. 28, 2018 (CN) ..... 201811623866.2

(51) Int. Cl.
*H01R 13/58* (2006.01)
*H01R 13/502* (2006.01)
*H01R 13/59* (2006.01)

(52) U.S. Cl.
CPC ..... *H01R 13/5812* (2013.01); *H01R 13/502* (2013.01); *H01R 13/59* (2013.01)

(58) Field of Classification Search
CPC ..... H01R 13/58; H01R 13/5804; H01R 13/5812; H01R 13/5816; H01R 13/582;
(Continued)

(56) References Cited

U.S. PATENT DOCUMENTS 4,070,085 A * 1/1978 Nelson ..... H01R 13/512 439/462
4,196,956 A * 4/1980 Hoffman ..... H01R 13/501 439/404
(Continued)

FOREIGN PATENT DOCUMENTS

CN 200976424 Y 11/2007
CN 201243181 Y 5/2009
(Continued)

OTHER PUBLICATIONS

Written Opinion and Search Report issued in corresponding International application No. PCT/CN2019/071639 (with English translation of Search report attached).

*Primary Examiner* — Marcus E Harcum
(74) *Attorney, Agent, or Firm* — Rumit Ranjit Kanakia

(57) ABSTRACT

A pre-wired management fastening device, including a tubular part composed of an integrally formed upper tubular party and a lower tubular part. An included angle is formed between the upper tubular and the lower tubular. Inside the tubular part has a channel. The front end of the tubular part has a cable clamping mechanism. The rear end of the tubular party is locked on the inlet of the electric plug connector or electric plug slot. It is convenient for the construction of on-site personnel, which makes the wiring of the cable more beautiful and reduces the difficulty of construction.

3 Claims, 10 Drawing Sheets

(58) Field of Classification Search
CPC ... H01R 13/5829; H01R 13/59; H01R 13/502
USPC ..... 439/456, 463, 465, 467, 454, 452, 460, 439/461, 462, 449
See application file for complete search history.

(56) References Cited

U.S. PATENT DOCUMENTS 4,202,590 A * 5/1980 Hoffman ..... H01R 13/501 439/467
4,563,049 A * 1/1986 Thibeault ..... H01R 13/502 439/462
4,640,569 A * 2/1987 Dola ..... H01R 12/775 439/461
5,511,993 A * 4/1996 Yamada ..... H01R 9/0524 439/607.5
5,833,490 A * 11/1998 Bouldin ..... H01R 13/523 439/462
6,116,945 A * 9/2000 Davis ..... H01R 13/5825 439/354
6,126,478 A * 10/2000 Presson ..... H01R 13/595 439/467
6,149,455 A * 11/2000 Levi ..... H01R 13/59 439/321
6,168,476 B1 * 1/2001 Yang ..... H01R 13/506 439/352
6,648,674 B1 * 11/2003 Dobler ..... H01R 13/5841 439/455
6,840,793 B2 * 1/2005 Finzer ..... F16B 29/00 439/465
7,201,604 B1 * 4/2007 Amidon ..... H01R 13/5825 439/418
7,255,587 B2 * 8/2007 Boeck ..... H01R 13/6275 439/358
8,246,377 B2 * 8/2012 Lindkamp ..... H01R 13/5829 439/461
8,262,406 B2 * 9/2012 Lindkamp ..... H01R 13/5841 439/470
8,702,444 B2 * 4/2014 Maranto ..... H01R 24/64 439/467
8,819,893 B2 * 9/2014 Shishido ..... F16L 5/02 16/2.2
9,461,400 B2 * 10/2016 Kanda ..... H01R 13/5829
9,553,402 B2 * 1/2017 Thelen ..... H01R 13/5825
10,116,083 B2 * 10/2018 Lin ..... H01R 13/512
10,601,171 B1 * 3/2020 Lin ..... H01R 13/582
10,840,635 B2 * 11/2020 Zellner ..... H01R 13/5825
2011/0300740 A1 * 12/2011 Schumann ..... H01R 13/5829 439/452
2013/0102185 A1 * 4/2013 Mulfinger ..... H01R 13/516 439/460
2015/0188268 A1 7/2015 Wu et al.
2015/0222048 A1 * 8/2015 Goulbourne ..... H01R 13/5841 439/456
2015/0280349 A1 * 10/2015 Thelen ..... H01R 13/5812 439/701
2015/0303615 A1 * 10/2015 Daugherty, Jr. ..... G02B 6/3887 385/55
2015/0372417 A1 * 12/2015 Dieduksman ..... H01R 13/5825 439/461

FOREIGN PATENT DOCUMENTS

CN 202434800 U 9/2012
CN 203800344 U 8/2014
CN 108598765 A 9/2018
DE 102017104982 B3 * 8/2018 ..... H01R 13/652

* cited by examiner

PRE-ORGANIZED WIRE FASTENING DEVICE, ELECTRIC PLUG CONNECTOR ADOPTING STRUCTURE AND FEMALE SEAT THEREOF

BACKGROUND OF THE INVENTION

Field of the Invention

The invention relates to a pre-wired management fastening device, which has a 360-degree four orientations and can be detachably connected to an electric plug connector or an electric plug slot.

Brief Discussion of the Related Art

The electrical plug connector or the terminatable electrical plug connector slot is a signal converter, as shown in FIGS. 1 and 2, which includes a connector shell 1 with an opening at the upper end and an upper fastener 2 hinged at the opening. The connector shell 1 is sequentially inserted and provided with a direct-pressure contacts module 3, a PCB circuit board 4, contact teeth 5, a terminal block 6, a wire cover 7 and a cable management base 8. The cable management base 8 is provided with an external screw thread and a through tube for cable routing, and a wire clamping mechanism 9 is at the upper end of the cable management base 8. The wire clamping mechanism 9 is fixed on the wire management base 8 with a fastening nut 10. In the process of engineering construction, sometimes it is necessary to change the routing direction of the cable for the convenience of wiring. At this time, the external plug of the electrical plug connector or the electrical plug connector slot is subject to a greater pulling force. Uneven force will affect the effectiveness of data transmission and increase the difficulty of construction.

SUMMARY OF THE INVENTION

In order to overcome the above-mentioned shortcomings, the object of the present invention is to provide a pre-wired management fastening device, which can change the routing position of the cable, make the cable easier to route, reduce the construction difficulty, and then ensure the effectiveness of data transmission.

In order to achieve the above object, the technical solution adopted by the present invention is: a pre-wired management fastening device, which is installed on a wiring port of an electric plug connector or an electric plug connector slot, and includes a tubular part. The tubular part consists of an integrally formed upper tubular part and a lower tubular part, one end of the upper tubular part is connected to one end of the lower tubular part, and an angle is formed between the upper tubular part and the lower tubular part, and the angle of the included angle is greater than or equal to 90 degrees and less than or equal to 180 degrees, so that it is convenient that the cable can be pre-arranged at any angle. The tubular part is provided with a channel for cable routing, which is consistent with the direction of the tubular part.

The front end of the tubular part is fixed on the tubular part by tightening the nut, and the rear end of the tubular part is locked at the incoming line entrance of the electric plug connector or electrical plug connector slot.

The invention assists the cable routing through the tubular part, can buffer the uneven stress caused by the external changes of the cable, improve the connection firmness of the cable in the wire-bonding cover, and thus enhance the stability of its data transmission. At the same time, it is also convenient for the construction of on-site personnel, which makes the wiring of the cable more beautiful and reduces the difficulty of construction.

Further, the tubular part is composed of a first shell and a second shell that are detachably connected. The first shell and the second shell are pivotally connected at one end, and the other end is formed by fitting or snapping together Channel for cable routing. The tubular parts can be detached and connected, which is convenient for on-site personnel to wire cables in the tubular parts and improve the convenience of on-site construction.

Further, the insides of the rear end of the first shell and the second shell are provided with semicircular screw thread mechanisms. When the first shell and the second shell are assembled, the two semicircular screw mechanisms form an open circle screw threaded mechanism. The above-mentioned open circular screw thread mechanism is an internal screw thread distributed at intervals, which can be screwed onto the line pipe on the cable management base to realize the installation and positioning of the tubular part. At the same time, the above-mentioned screw thread connection also facilitates the disassembly and installation of the tubular part and improves the convenience of installation of the tubular part.

Further, the wire clamping mechanism is an injection molded part with surface electroplating treatment. Through the surface electroplating treatment, the toughness of the injection molded part is preserved, the electrical conductivity is increased, and the signal crosstalk phenomenon is better handled. The above-mentioned wire clamping mechanism includes a ring-shaped base, at least one side of the ring-shaped base is provided with 2 to 6 wire clamping support columns, and the outer side of the head of the cable clamping supporting columns is provided with barbs. The columns and barbs shift gradually toward the middle during the tightening process by tightening a fastening nut. The inner side of the tail cable inlet of the tightening nut is provided with a contraction slope. When it is tightened, the contraction slope squeezes the wire clamping support columns and makes the internal connection in a fixed state after installation, which is not pulled by the rear end cable to change the state ensures stable signal transmission. The above-mentioned cable clamping supporting columns are evenly distributed on the annular base.

Further, the front end of the tubular part is provided with an external thread adapted to the internal thread of the fastening nut, and the tubular part located at the location of the external screw thread on the tubular part is provided with a through-groove for embedding the cable clamping support column.

Preferably, the angle between the upper tubular part and the lower tubular part is 90 degrees or 135 degrees, and the above two angles are used most frequently.

Preferably, the pivot connection between the first shell and the second shell includes a buckle groove provided on the second shell, and a pair of buckle steps are provided in the buckle groove. A clamping column that can be installed in the step of buckling is provided on the first shell. In addition to the traditional cylindrical structure, the clamping shape can also be an irregular ellipse. When the irregular ellipse shape is adopted, it is not easy to fall off when twisted in the buckling step, and the stability is good.

A 90-degree terminatable electrical plug connector slot including a connector shell, the upper end of the connector shell is an opening, and an upper fastener is hinged at the opening. The insert is provided with a direct pressure ferrule, a PCB circuit board, a contact teeth, a terminal base, a wire cover and a wire management base, the upper fastener is buckled on the wire cover. The conduit of the cable management base is provided with the above-mentioned pre-wired management fastening device.

A 180-degree terminatable electrical plug connector slot, comprising a connector shell, an upper end of the connector shell is hinged with an upper fastener, and a lower end of the connector shell is hinged with a lower fastener. The connector shell is sequentially inserted and provided with a direct pressure ferrule, a PCB circuit board, a contact teeth, a terminal block, and a wire cover. A raised part, which is the rear end of the tubular part, is used to fasten the upper fastener and the lower fastener. The front end of the tubular part fix the cable clamping mechanism on the tubular part by fastening the nut. The tubular part is composed of an integrally formed upper tubular part and a lower tubular part. One end of the upper tubular part is connected to one end of the lower tubular part, and the upper tubular part and the lower tubular part form an angle. The angle of the included angle is greater than or equal to 90 degrees and less than or equal to 180 degrees.

An electric plug connector, including a connector shell, the cable entry opening at the rear of the connector shell is provided with the above-mentioned pre-wired management fastening device.

The invention provides two different types of plug connector bases, both of which adopt pre-wired management fastening device to ensure the convenience and stability of plug connector slot cable installation, and it is convenient and beautiful for wiring. It also can solve the problems affecting data transmission stability in engineering construction and reduce construction difficulty.

DETAILED DESCRIPTION OF THE PREFERRED EMBODIMENTS

The following is a detailed description of the preferred embodiments of the invention in combination with the accompanying drawings, so that the advantages and features of the invention can be more easily understood by those skilled in the art, so as to make a clearer and clear definition of the protection scope of the invention.

Embodiment

Figure 1:
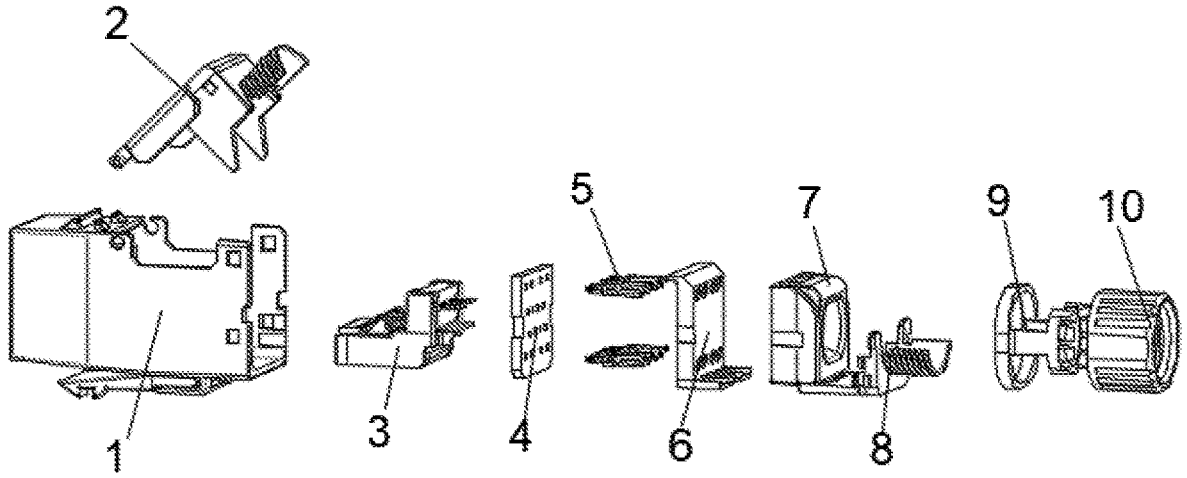
Figure 1 (Prior Art)
FIG. 1 is an exploded schematic view of an electric plug connector or an electric plug connector slot in the prior art.
Figure 2:
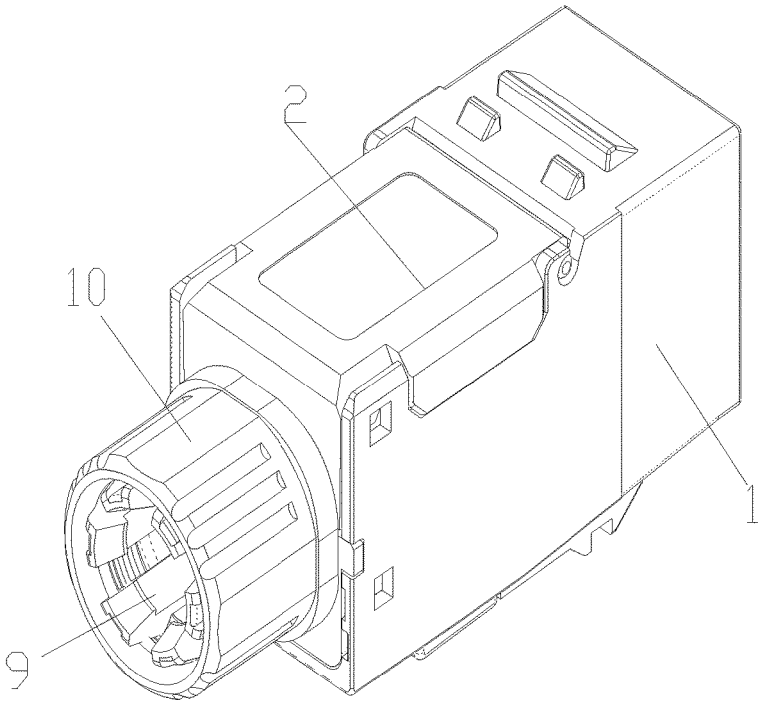
Figure 2 (Prior Art)
FIG. 2 is a perspective view of an electric plug connector or an electric plug connector slot in the prior art.
Figure 3:
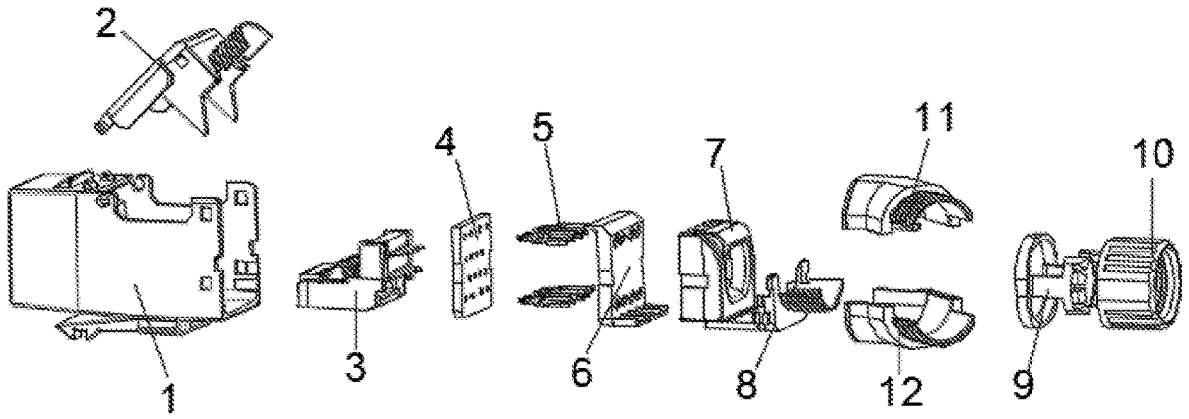
FIG. 3 is an exploded schematic view of the electrical plug connector slot in Embodiment 1 of the present invention.

As shown in FIG. 3, a 90 degree wiring plug connector slot in the embodiment includes a connector shell 1, the upper end of which is an opening, and the opening is hinged with an upper fastener 2. The connector shell 1 is successively inserted with a direct compression type plug core 3, a PCB circuit board 4, cable cutter 5, a terminal block 6, a wire cover 7 and a wire management base 8, and the upper fastener 2 is buckled in the cable cover 7. The wire management base 8 is provided with a conduit for cable routing, and the outer side of the conduit is provided with an external thread. A pre-wired management fastening device is arranged on the conduit, which can change the direction of cable routing and facilitate on-site construction.

The pre-wired management fastening device includes a tubular part. The tubular part consists of an integrally formed upper tubular part and a lower tubular part, one end of the upper tubular part is connected to one end of the lower tubular part, and an angle is formed between the upper tubular part and the lower tubular part, and the angle of the included angle is greater than or equal to 90 degrees and less than or equal to 180 degrees, so that it is convenient that the cable can be pre-arranged at any angle. The tubular part is provided with a channel for cable routing, which is consistent with the direction of the tubular part.

Figure 4:
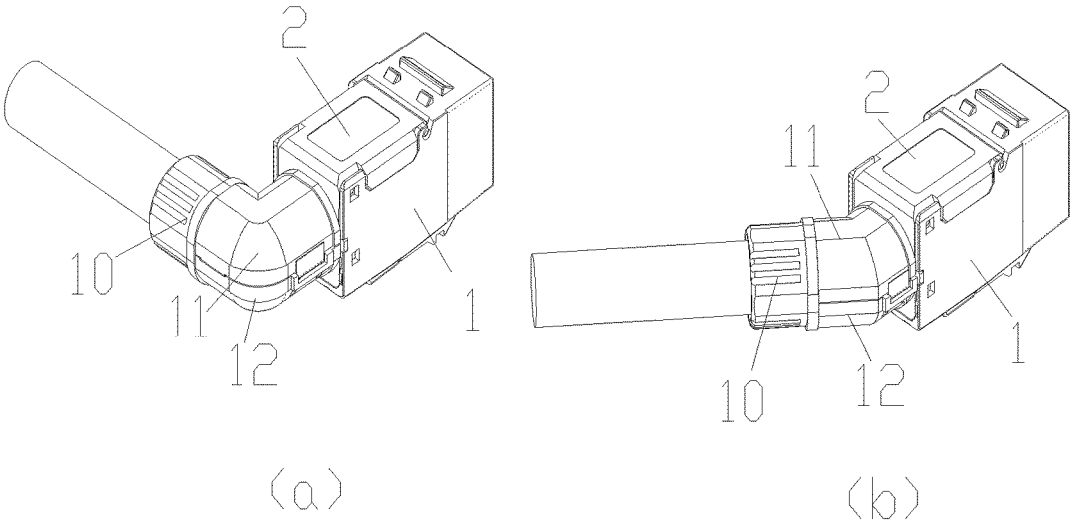
FIG. 4 is a perspective view of an electric plug connector slot in Embodiment 1 of the present invention.
Figure 12:
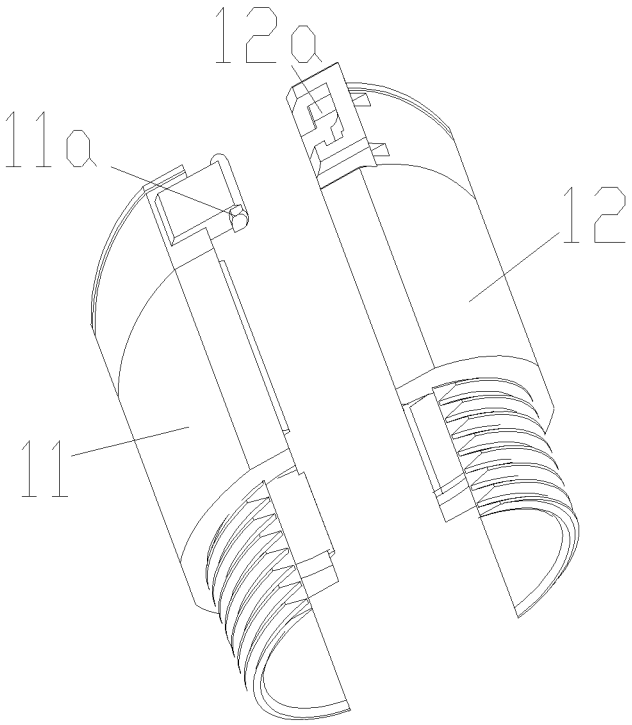
FIG. 12 is a perspective view of the first shell and the second shell in Embodiment 1 of the present invention.

The front end of the tubular part is fixed to the tubular part by fastening nut 10, and the rear end of the tubular part is locked to the inlet of the plug connector slot. From FIG. 4 (a\b), it is known that the tubular part consists of a detachable first shell 11 and a second shell 12. The first shell 11 and the second shell 12 are pivotally connected at one end, and the other end is formed by fitting or snapping together Channel for cable routing. As shown in FIG. 12, the pivot connection in this Embodiment includes a buckle groove 12*a* on the second shell 12, which has a pair of buckle steps within 12*a*. A clamping column 11*a* that can be installed in the step of buckling is provided on the first shell 11. In addition to the traditional cylindrical structure, the clamping 11*a* shape can also be an irregular ellipse. When the irregular ellipse shape is adopted, it is not easy to fall off when twisted in the buckling step, and the stability is good.

The tubular parts can be detached and connected, which is convenient for on-site personnel to wire cables in the tubular parts and improve the convenience of on-site construction. The angle between the upper tubular part and the lower tubular part is 90 degrees (FIG. 4(*a*)) and 135 degrees (FIG. 4(*b*)).

Figure 5:
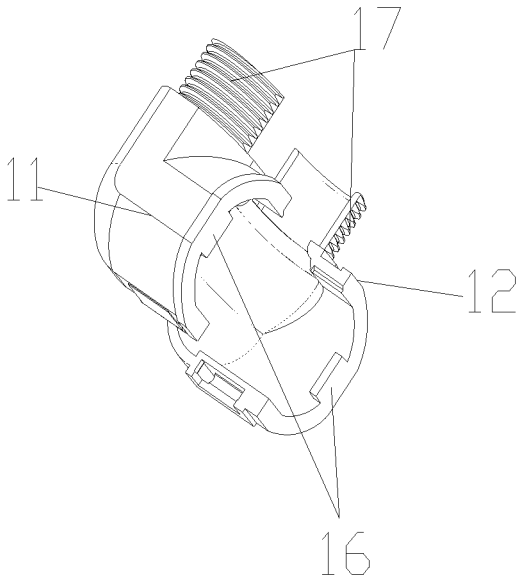
FIG. 5 is a perspective view of the tubular part in Embodiment 1 of the present invention.

As shown in FIG. 5, the insides of the rear end of the first shell 11 and the second shell 12 are provided with semicircular screw thread mechanisms 16. When the first shell 11 and the second shell 12 are assembled, the two semicircular screw mechanisms 16 form an open circle screw threaded mechanism. The above-mentioned open circular screw thread mechanism is an internal screw thread distributed at intervals, which can be screwed onto the line pipe on the cable management base 8 to realize the installation and positioning of the tubular part. At the same time, the above-mentioned screw thread connection also facilitates the disassembly and installation of the tubular part and improves the convenience of installation of the tubular part. 5. The front end of the tubular part is provided with an external screw thread 17 adapted to the internal screw thread of the fastening nut, located at the location of the external screw thread 17 on the tubular part is provided with a through-groove for embedding the cable clamping support column.

Figure 6:
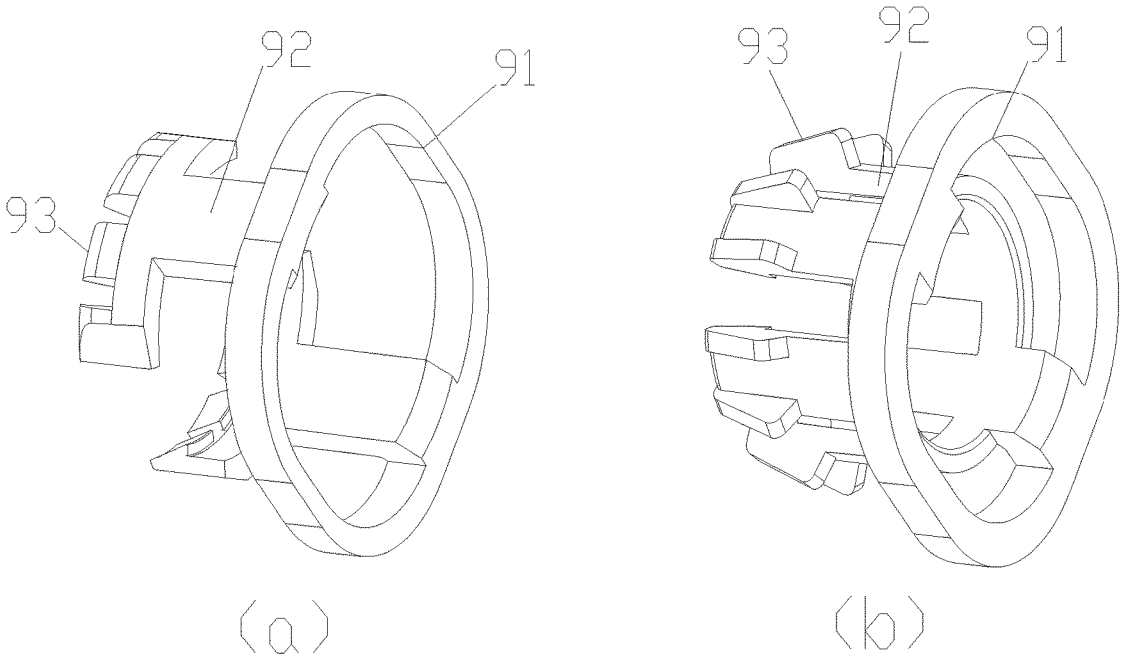
FIG. 6 is a perspective view of a wire clamping mechanism in Embodiments 1 and 2 of the present invention.
Figure 11:
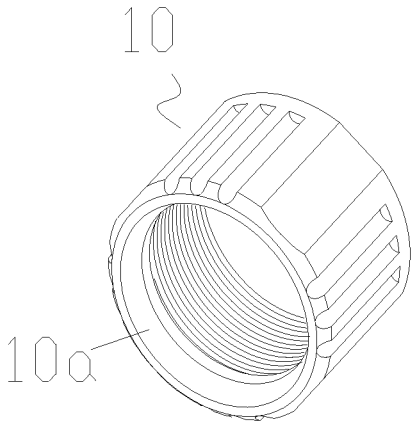
FIG. 11 is a perspective view of a fastening nut in Embodiment 1 of the present invention.

With reference to FIG. 6 (a\b), the wire clamping mechanism 9 is an injection molded part with surface electroplating treatment. Through the surface electroplating treatment, the toughness of the injection molded part is preserved, the electrical conductivity is increased, and the signal crosstalk phenomenon is better handled. The above-mentioned wire clamping mechanism 9 includes a ring-shaped base 91, at least one side of the ring-shaped base 91 is provided with 2 to 6 wire clamping support columns 92, and the outer side of the head of the cable clamping supporting columns 92 is provided with barbs 93. The columns and barbs 93 shift gradually toward the middle during the tightening process by tightening a fastening nut 10. As shown in FIG. 11, the inner side of the tail cable inlet of the tightening nut 10 is provided with a contraction slope 10*a*. When it is tightened, the contraction slope 10*a* squeezes the wire clamping support columns 92 and makes the internal connection in a fixed state after installation, which is not pulled by the rear end cable to change the state ensures stable signal transmission. The above-mentioned cable clamping supporting columns 92 are evenly distributed on the annular base. During the tightening process of the tightening nut 10, the cable clamping supporting columns 92 and the barbs 93 close to the middle to achieve the function of clamping the cable, to ensure that the cable and electricity will not be in poor contact with electrical plug connector slot and the signal transmission will not be unstable caused by the construction during the operation of the example.

The invention assists the cable routing through the tubular part, can buffer the uneven stress caused by the external changes of the cable, improve the connection firmness of the cable in the wire-bonding cover, and thus enhance the stability of its data transmission. At the same time, it is also convenient for the construction of on-site personnel, which makes the wiring of the cable more beautiful and reduces the difficulty of construction.

Embodiment 2

Figure 7:
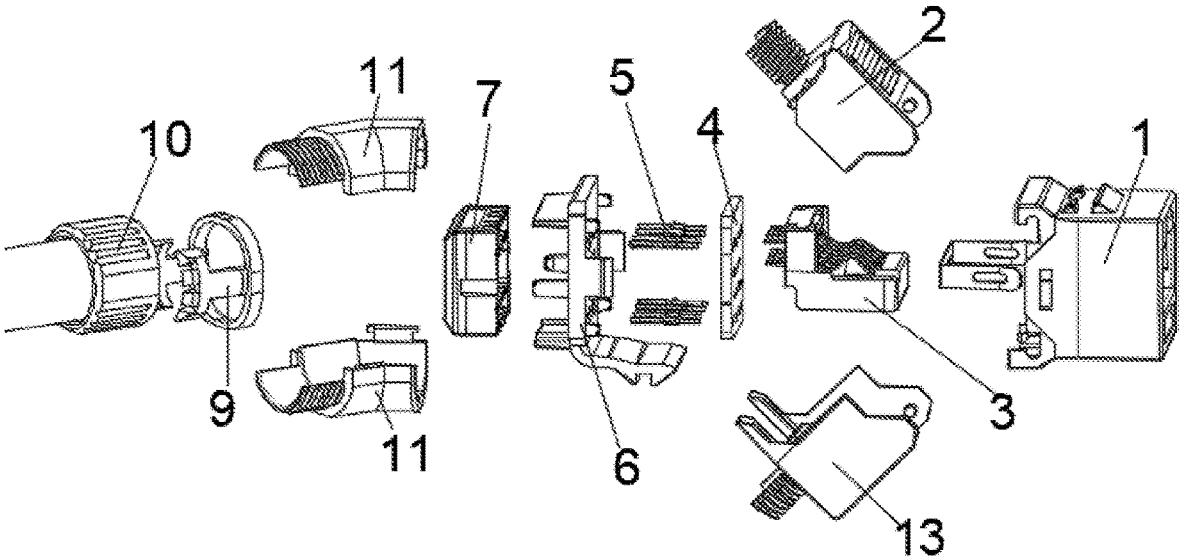
FIG. 7 is an exploded schematic view of the electric plug connector slot in Embodiment 2 of the present invention.
Figure 8:
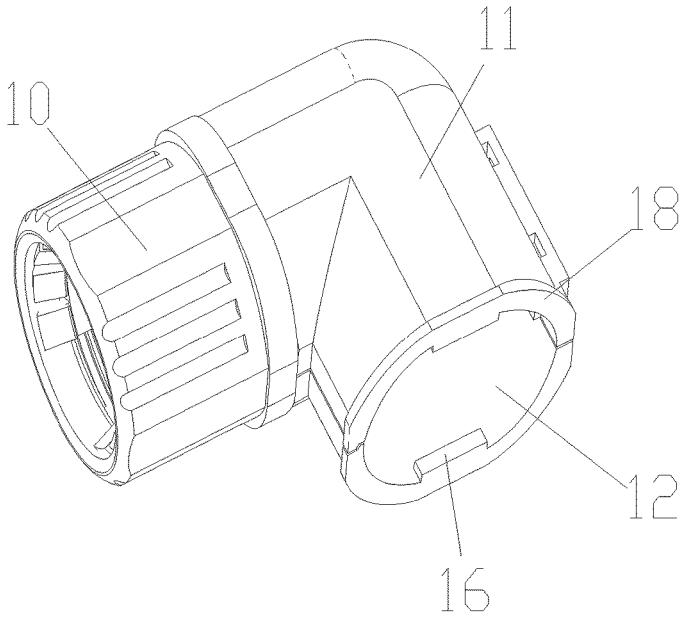
FIG. 8 is a perspective view of a tubular part in Embodiment 2 of the present invention.
Figure 9:
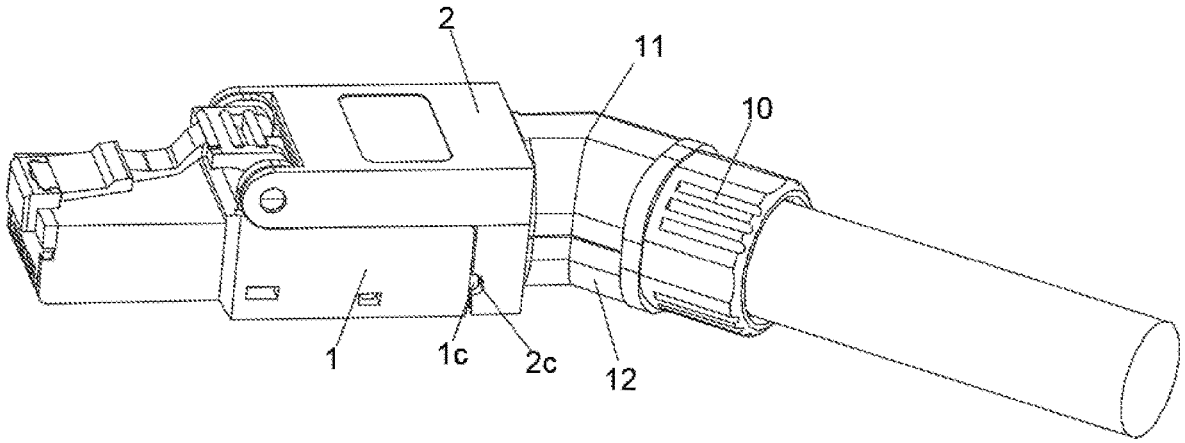
FIG. 9 is a perspective view of an electric plug connector in Embodiment 3 of the present invention (with a pre-wired management fastening device).
Figure 10:
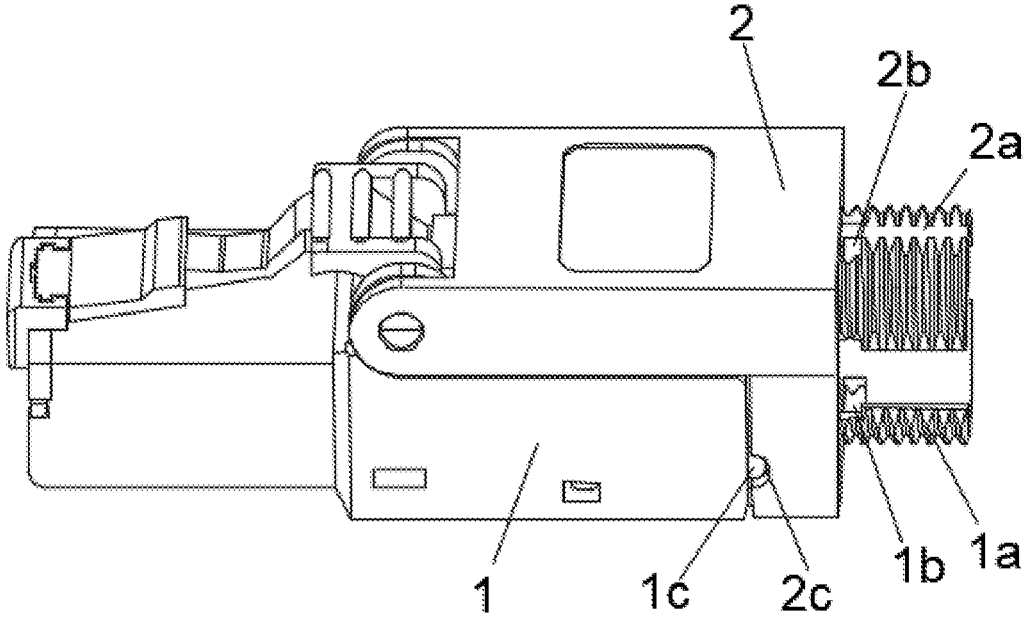
FIG. 10 is a perspective view of an electric plug connector in Embodiment 3 of the present invention.

As shown in FIG. 7, a 180-degree terminatable electrical plug connector slot, comprising a connector shell 1, an upper end of the connector shell 1 is hinged with an upper fastener 2, and a lower end of the connector shell 1 is hinged with a lower fastener 13. The connector shell 1 is successively inserted with a direct compression type plug core 3, a PCB circuit board 4, cable cutter 5, a terminal block 6, a wire cover 7. The above structure belongs to the existing product structure. This embodiment has been improved on the basis of the original, and a pre-wired management fastening device is added to the tail portion. As in Embodiment 1, pre-wired management fastening device in this embodiment includes a tubular part. The front end of the tubular part fix the cable clamping mechanism on the tubular part by fastening the nut 10 (The nut is the same as in Embodiment 1). The tubular part is composed of a detachably connected first shell 11 and a second shell 12, the first shell 11 and the second shell 12 one end is pivotally connected, and the other end is attached or buckled to form a channel for cable routing. The tubular part in this embodiment is the same as in Embodiment 1 and the tubular part consists of an integrally formed upper tubular part. A lower tubular part, one end of the upper tubular part is connected to one end of the lower tubular part, and an angle is formed between the upper tubular part and the lower tubular part, and the angle of the included angle is greater than or equal to 90 degrees and less than or equal to 180 degrees.

The pre-wired management fastening device in this embodiment is different from the pre-wired management fastening device in embodiment 1 is:

When the upper fastener 2 and the lower fastener 13 are buckled to lock the protrusion 18, thus fixing the tubular part to the f the electric plug connector slot.

Embodiment 3

An electric plug connector, including a connector shell 1, the upper end of the connector shell 1 is an opening, and an upper fastener 2 is hinged at the opening. The upper fastener 2 comprise a pair of fastening hooks 2*c*, and the rear of the connector shell 1 has two fastening points 1*c* corresponding to the fastening hooks 2*c*. In the Embodiment, after the cable is pressed in, fasten the connector by fastening the hook 2C and the clamping point 1C, which is more convenient for the installation of the rear-end pre-wire management device. The outer side of the connector shell 1 is integrally molded with an arc plate A1A with a thread, The outer side of the connector shell 2 is integrally molded with an arc plate B2*a* with a thread. When the arc plate Ala and the arc plate B2*a* are engaged, a cylindrical threaded port is formed. The thread opening is provided with a pre-wired management fastening device, and the pre-wired management fastening device is consistent with the pre-wire management device in Embodiment 1. In this embodiment, the arc plate A1*a* is provided with a locking port A1*b* on the side close to the connector shell 1, and the arc plate B2*a* is provided with a locking port B2*b* on the side close to the upper fastener 2. When the pre-wired management fastening device in Embodiment 1 is used to install on the threaded port, the two semicircular threaded mechanisms 16 can be embedded into the corresponding locking ports B2*b* and A1*b*.

Figure 13:
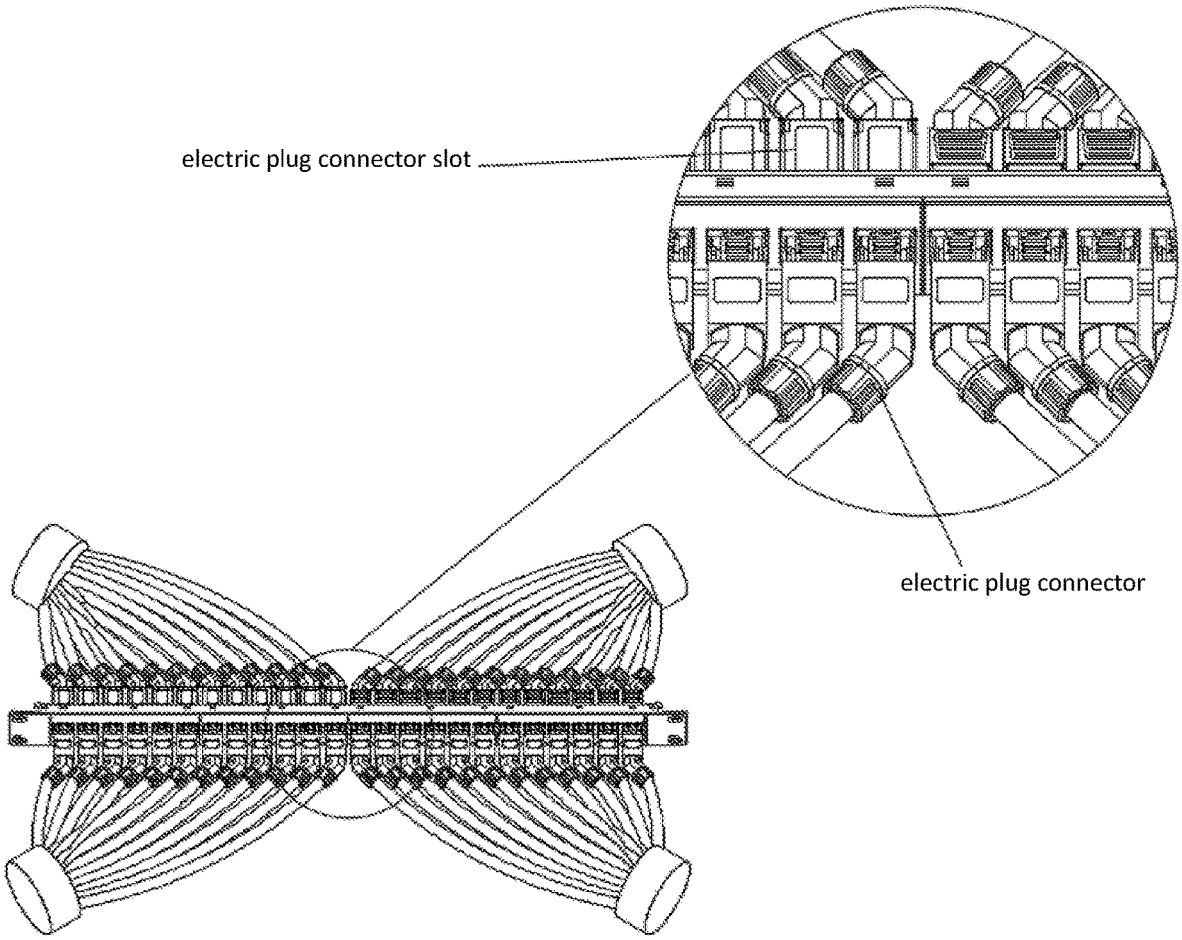
FIG. 13 is a combination diagram of a 45-degree pre-wire management in the present invention.
Figure 14:
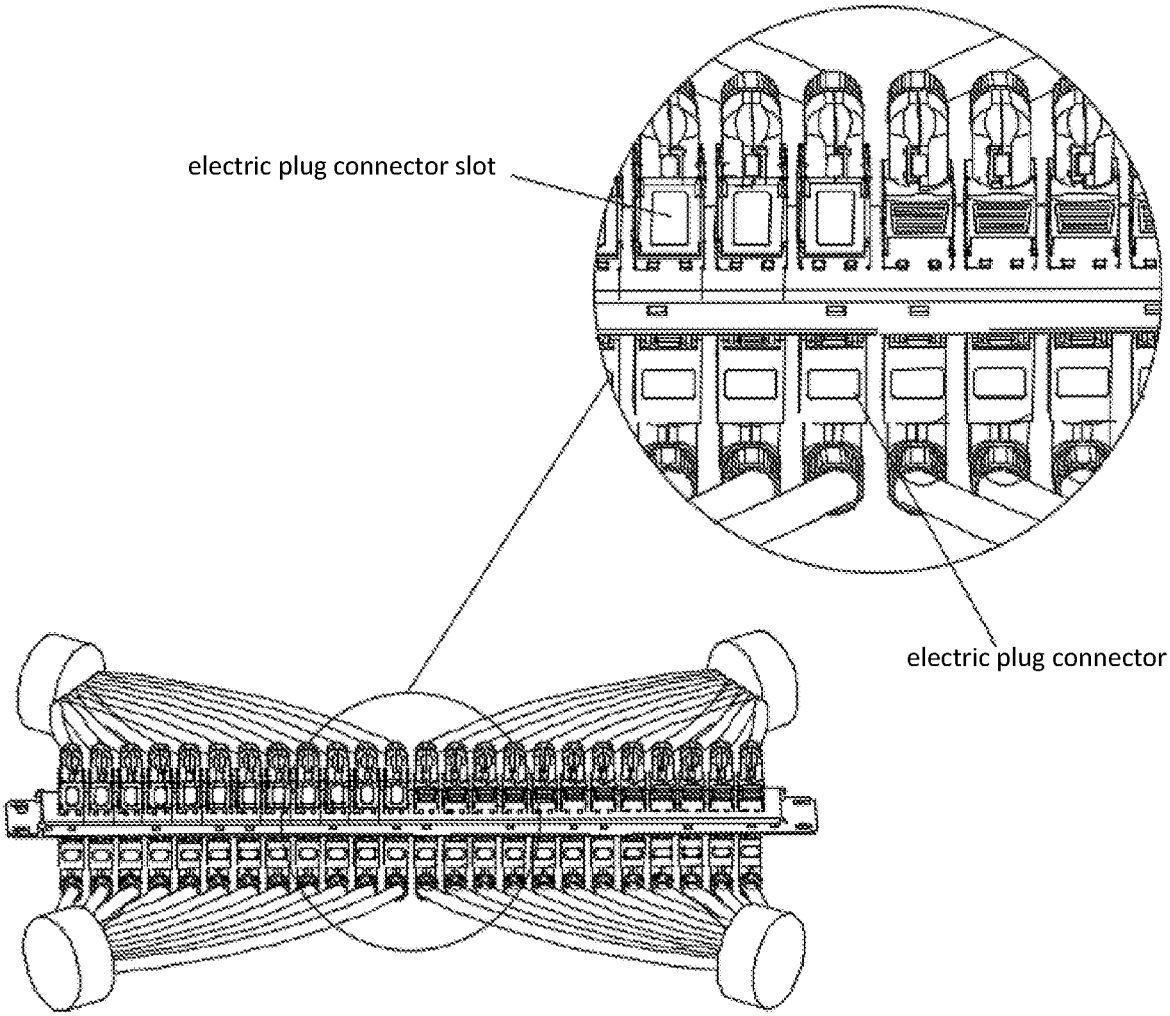
FIG. 14 is a combination diagram of a 90-degree pre-wire management in the present invention.
Figure 15:
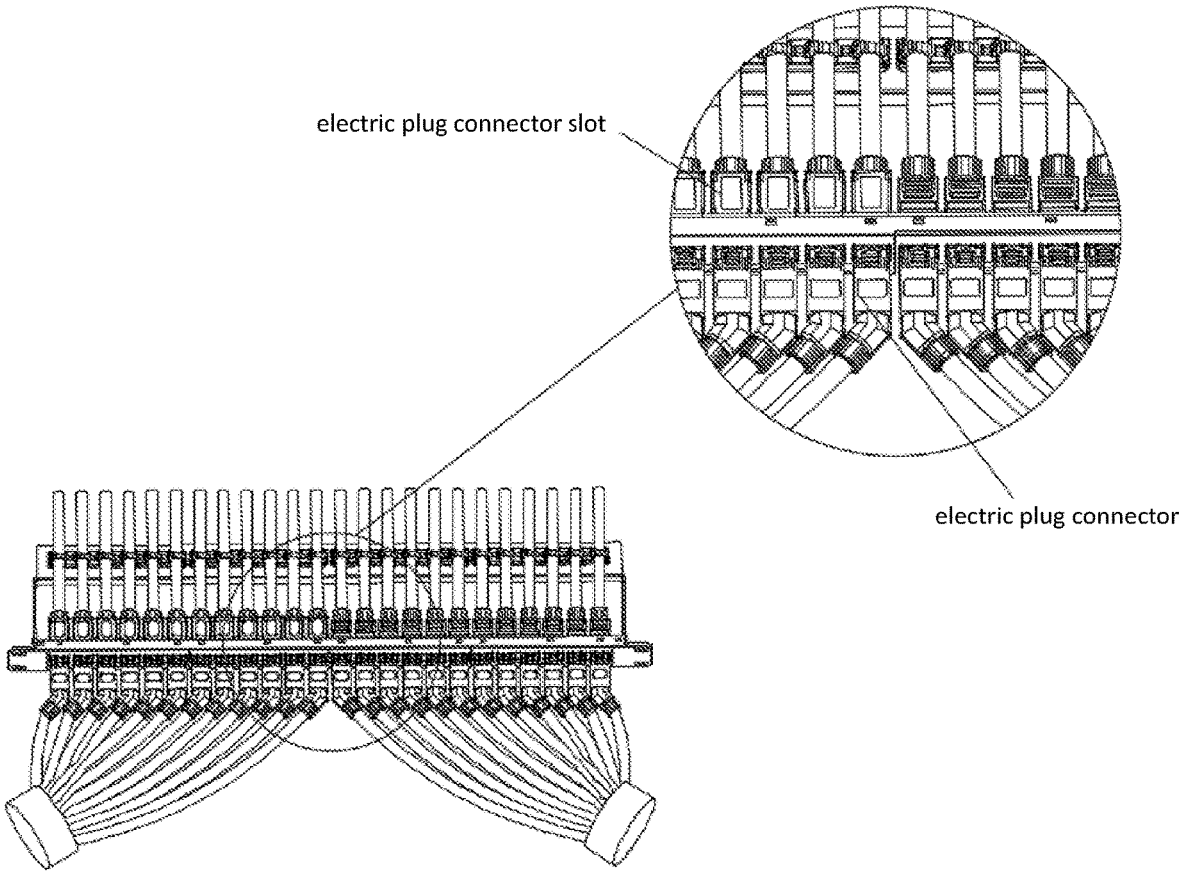
FIG. 15 is a combination diagram when 45 degrees and 180 degrees pre-wire management are used in combination in the present invention

When several electric plug connectors with pre-wired management fastening device and electric plug connector slots are installed in combination, the electric plug connector and electric plug connector slots shown in FIG. 13 are both 45 degrees. The electric plug connector and electric plug connector slots in FIG. 14 both use a 90-degree pre-wired management fastening device. As shown in FIG. 15, 45 degree pre-wired management fastening device is adopted for electric plug connector, and 180 degree pre-wired management fastening device is used for electric plug connector slot. It can be seen from the above combination diagram that the overall layout is beautiful and convenient for field wiring.

The invention assists the cable routing through the tubular part, can buffer the uneven stress caused by the external changes of the cable, improve the connection firmness of the cable in the wire-bonding cover, and thus enhance the stability of its data transmission. At the same time, it is also convenient for the construction of on-site personnel, which makes the wiring of the cable more beautiful and reduces the difficulty of construction.

The above implementation mode is only to illustrate the technical conception and characteristics of the invention, and its purpose is to let people familiar with the technology understand the content of the invention and implement it, and cannot limit the protection scope of the invention. All equivalent changes or modifications made according to the spiritual essence of the invention shall be covered in the protection scope of the invention.

The invention claimed is:

1. A pre-wired management fastening device, installed on the cabling port of an electric plug connector or an electric plug connector slot, the pre-wired management fastening device comprising:

a tubular part comprising:

an integral upper tubular part;

a lower tubular part, an angle being formed between the upper tubular part and the lower tubular part, the angle being greater than or equal to 90 degrees and less than or equal to 180 degrees; and a channel for cable routing consistent with a direction of the tubular part; and a cable clamping mechanism fixed to a front end of the tubular part fixes by a nut, wherein a rear end of the tubular part is locked on an inlet of the electric plug connector or an other end of the electric plug connector, wherein the cable clamping mechanism is an injection-molded part with surface plating treatment, and comprises:

an annular base;

2-6 cable clamping supporting columns on at least one side of the annular base; and barbs disposed on an outer side of a head of the cable clamping supporting columns, wherein a slanted inside surface of a bottom inlet of a nut is contracted by tightening a fastening nut to make the cable clamping supporting columns and the barbs shift gradually during a tightening process.

2. A 90-degree terminatable electrical plug connector slot comprising:

a connector shell;

an opening in an upper end of the connector shell;

an upper fastener hinged at the opening;

an insert provided with a direct pressure ferrule, a PCB, a contact teeth, a terminal base, a wire cover and a wire management base, wherein the upper fastener is buckled on the wire cover, wherein the wire management base is provided with a pre-wired management fastening device installed on the cabling port of an electric plug connector or an electric plug connector slot, the pre-wired management fastening device comprising:

a tubular part comprising:

an integral upper tubular part;

a lower tubular part, an angle being formed between the upper tubular part and the lower tubular part, the angle being greater than or equal to 90 degrees and less than or equal to 180 degrees; and a channel for cable routing consistent with a direction of the tubular part; and a cable clamping mechanism fixed to a front end of the tubular part fixes by a nut, and wherein a rear end of the tubular part is locked on an inlet of the electric plug connector or an other end of the electric plug connector.

3. A 180-degree terminatable electrical plug connector slot, comprising a connector housing, an upper end of a connector shell being hinged with an upper fastener, and a lower end of the connector shell hinged with a lower fastener; the connector shell is sequentially inserted and provided with a direct pressure ferrule, a PCB, a contact teeth, a terminal block, and a wire cover; wherein a raised part, which is a rear end of a tubular part, is used to fasten the upper fastener and the lower fastener; a front end of the tubular part fix a cable clamping mechanism on the tubular part by fastening a nut; the tubular part is composed of an integrally formed upper tubular part and a lower tubular part; one end of the upper tubular part is connected to one end of the lower tubular part, and the upper tubular part and the lower tubular part form an angle; and the angle of the included angle is greater than or equal to 90 degrees and less than or equal to 180 degrees.

* * * * *